US006025822A

United States Patent [19]

Motegi et al.

[11] Patent Number: 6,025,822

[45] **Date of Patent: *Feb. 15, 2000**

[54] DRIVING DEVICE, A COLUMN ELECTRODE DRIVING SEMICONDUCTOR INTEGRATED CIRCUIT AND A ROW ELECTRODE DRIVING SEMICONDUCTOR INTEGRATED CIRCUIT USED FOR A LIQUID CRYSTAL DISPLAY DEVICE

[75] Inventors: Hiroyuki Motegi; Takeshi Kuwata; Yutaka Nakagawa; Akira Nakazawa, all of Yokohama, Japan

[73] Assignee: Asahi Glass Company Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/859,033

[22] Filed: May 20, 1997

Related U.S. Application Data

[63] Continuation of application No. 08/651,503, May 22, 1996, abandoned, which is a continuation of application No. 08/417,768, Apr. 6, 1995, abandoned.

[30] Foreign Application Priority Data

Apr. 7, 1994 [JP] Japan ..... 6-069639

[51] Int. Cl.[7] ..... G09G 3/36

[52] U.S. Cl. ..... 345/98; 345/100

[58] Field of Search ..... 345/95, 87, 88, 345/92, 97, 98, 100, 103; 359/54, 56; 365/154; 349/41, 33, 42, 34, 47

[56] References Cited

U.S. PATENT DOCUMENTS

| | | | |
|---|---|---|---|
| 3,990,056 | 11/1976 | Luisi et al. | 365/154 |
| 5,101,116 | 3/1992 | Morokawa | 345/95 |
| 5,212,477 | 5/1993 | Indekeu et al. | 345/127 |
| 5,262,881 | 11/1993 | Kuwata et al. . | |
| 5,363,118 | 11/1994 | Okumura | 345/95 |
| 5,489,919 | 2/1996 | Kuwata et al. . | |
| 5,585,816 | 12/1996 | Scheffer et al. | 345/100 |

OTHER PUBLICATIONS

HD 66108 (RAM–Provided 165–Channel LCD Driver for Liquid Crystal Dot Matrix Graphics, pp. 638–690.

*Primary Examiner*—Chanh Nguyen
*Attorney, Agent, or Firm*—Oblon, Spivak, McClelland, Maier & Neustadt, P.C.

[57] ABSTRACT

A column electrode driving semiconductor integrated circuit for driving column electrodes in a liquid crystal display device to be driven by a multiple line selection method wherein the liquid crystal display device has a select and output circuit which selects a specified voltage value among voltage values having the member of levels corresponding to the member of simultaneously selected row electrodes, and applies the selected voltage value to each column electrode, wherein a memory unit including a control circuit stores display data and outputs the data on each row electrode in simultaneously selected lines, and an arithmetic circuit unit including an arithmetic processing circuit receives the data outputted from the memory unit and selection data indicating a voltage pattern applied to a selected row electrode and produces by arithmetic processing information of voltages selected by the select and output circuit unit.

13 Claims, 12 Drawing Sheets

90, 91: INVERTERS 90, 91: INVERTERS

FIGURE 9
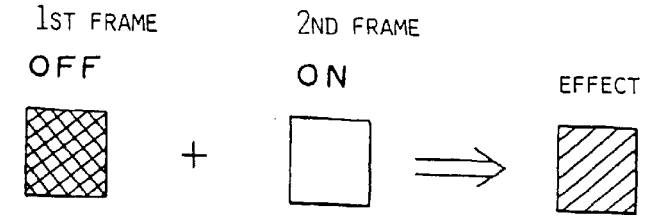
FIGURE 10 *PRIOR ART*
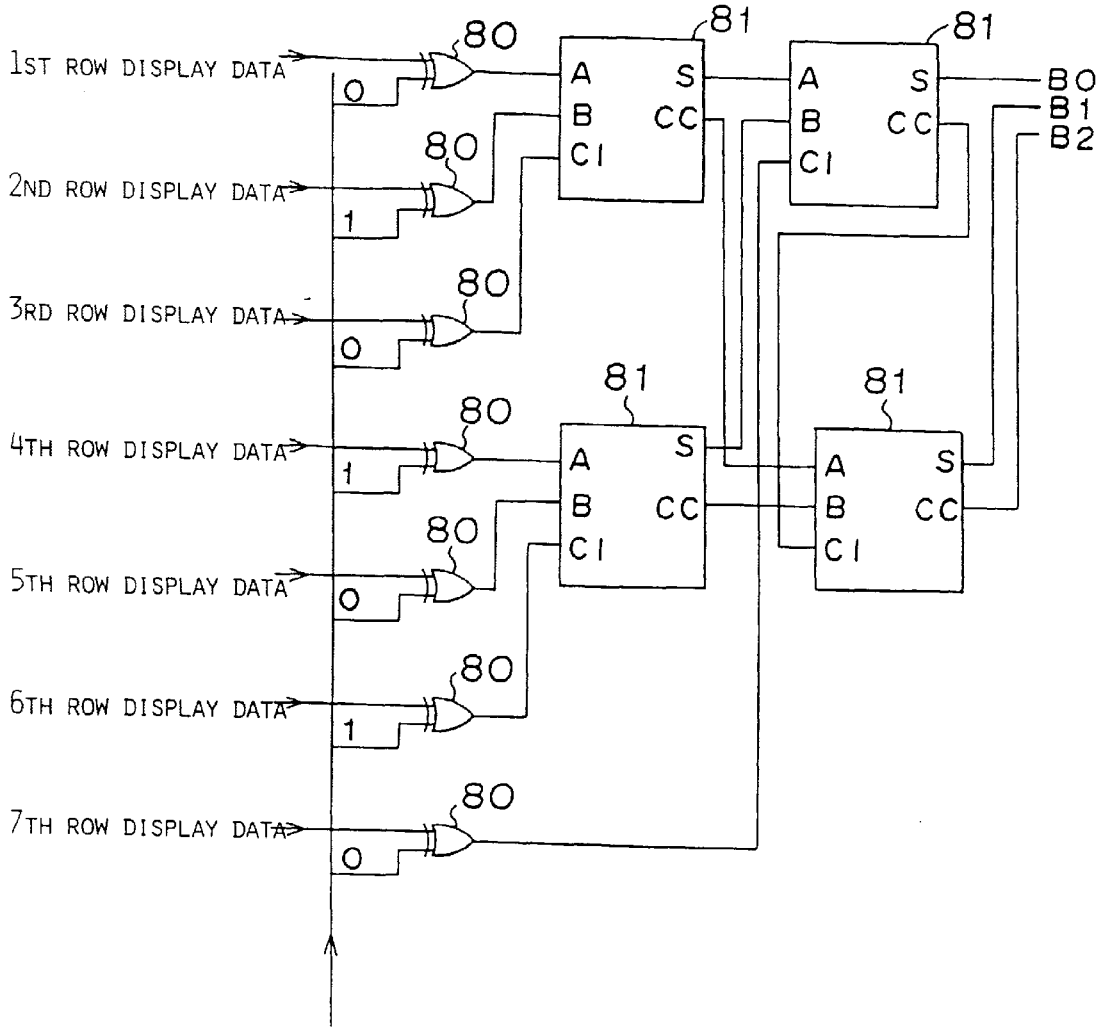

FIGURE 13

*PRIOR ART*

$$\begin{pmatrix} 1 & 0 & 1 & 0 & 1 & 0 & 1 & 0 \\ 1 & 1 & 0 & 0 & 1 & 1 & 0 & 0 \\ 1 & 0 & 0 & 1 & 1 & 0 & 0 & 1 \\ 1 & 1 & 1 & 1 & 0 & 0 & 0 & 0 \\ 1 & 0 & 1 & 0 & 0 & 1 & 0 & 1 \\ 1 & 1 & 0 & 0 & 0 & 0 & 1 & 1 \\ 1 & 0 & 0 & 1 & 0 & 1 & 1 & 0 \end{pmatrix}$$

a

DRIVING DEVICE, A COLUMN ELECTRODE DRIVING SEMICONDUCTOR INTEGRATED CIRCUIT AND A ROW ELECTRODE DRIVING SEMICONDUCTOR INTEGRATED CIRCUIT USED FOR A LIQUID CRYSTAL DISPLAY DEVICE

This application is a Continuation of application Ser. No. 08/651,503 which is a Continuation of Ser. No. 08/417,768 filed on May 22, 1996 and Apr. 6, 1995 respectively, now abandoned.

BACKGROUND OF THE INVENTION

1. Field of the Invention

The present invention relates to a driving device, a column electrode driving semiconductor integrated circuit and a row electrode driving semiconductor integrated circuit which are used mainly for driving a liquid crystal display element.

2. Discussion of Background

FIG. 7 is a block diagram showing schematically the construction of a conventional liquid crystal display device. In FIG. 7, a liquid crystal panel 20 for displaying pictures has a number of super-twisted nematic (STN) liquid crystal display elements which are arranged in a matrix form so as to correspond to pixels. In the vicinity of the liquid crystal panel 20, there are arranged row drivers (Y drivers) 22 formed of a semiconductor integrated circuit (a large scale integrated circuit, hereinbelow, referred to as a LSI) which drives scanning lines and column drivers (X drivers) 21 formed of a LSI which outputs display data to the display panel 20.

As shown in FIG. 7, a plural number of column drivers 21 and row drivers 22 are generally used in order to drive a large number of scanning lines to thereby output a large number of a display data. Each of the column drivers 21 includes a latch circuit to latch display data on selection lines and a selection circuit to select applied voltages. Each of the row drivers 22 includes a shift register to shift a signal indicating a selection line and a selection circuit to select a voltage applied to a scanning line. In a case of using a monochrome VGA panel comprising X=640 dots and Y=480 dots for instance, four column drivers 21 and four row drivers 22 are used. In this case, each of the row drivers 22 takes charge of a 480/4=120 number of outputs 27. Namely, it outputs 120 selection signals. Further, each of the column drivers 21 takes charge of a 640×4=160 number of outputs 28. Namely, each of the column drivers 22 applies voltage levels necessary for an ON/OFF display to the liquid crystal panel 21 through the 160 number of outputs 28.

A controller 23 is to write input display data in a RAM 24 once and to supply control signals to the column drivers 21 and the row drivers 22 through control signal lines 25, 26. When a dot matrix type liquid crystal display device is used, address signals and read/write signals are supplied from the controller 23 to the RAM 24 to read or write display data. When a plurality of display RAMs 24 are provided, chip select signals are supplied from the controller 23 to the display RAMS.

Control signals to be supplied from the controller 23 to the column drivers 21 include display data, clocks for taking the display data, enable signals for activating the column drivers, latch pulses for outputting data to the liquid crystal panel 20, voltages for liquid crystal display to be applied to the liquid crystal panel 20 by means of the column drivers and signals for transforming liquid crystal driving outputs into an alternating current form.

Control signals supplied from the controller 23 to the row drivers 22 include selection data (shift data), shift clocks for shifting the selection data, voltages for liquid crystal display to be applied to the liquid crystal display panel 20 by means of the row drivers and signals for transforming liquid crystal display outputs into an alternating current form.

As described above, the liquid crystal display device, in particular, the liquid crystal display apparatus having a large-sized liquid crystal panel 20, requires a large number of control signals, a large number of drivers 21, 22, memories having a large capacity and the controller 23 of a large scale.

In a case of using the liquid crystal panel 20 for color display, 3 dots for R, G and B colors are required for a pixel. For instance, in a display panel comprising 640×480 pixels, a 640×3×480 number of liquid crystal display elements are required. Accordingly, the quantity of data to be treated is three times, and the number of the column drivers 21 is three times as much as the case of a monochrome display. Thus, the construction of the circuit in such a color liquid crystal display device is complicated and large.

In the above-mentioned liquid crystal display device, a scanning line is selected at a time. Recently, however, there has been developed methods wherein the liquid crystal display device is driven by selecting a plurality of scanning lines at a time. In the driving methods, there is a method of selecting the entire lines at a time as disclosed in the publication of EP 507061. Further, there is a method of dividing all the scanning lines into several groups and selecting the lines in each group at a time, as disclosed in U.S. Pat. No. 5,262,881. FIG. 8 is a block diagram showing the construction of a driving circuit for the liquid crystal display device which is suitable for these methods.

In FIG. 8, A-D converters 31R, 31G and 31B are adapted to convert R, G and B data to be displayed into digital data. A corrector 32 is to store each of the digital data to a display RAM 24 after the digital data are subjected to a γ-correction or the like. A data selector 34 reads out data from the display RAM 24 in accordance with a predetermined algorithm so that the data are stored in memories 35*a*–35*n*. Gray shade control circuits 36*a*–36*n* read data from the memories 35*a*–35*n* to conduct a gray shade control to the data. An arithmetic circuit 37 performs predetermined arithmetic operations to row selection patterns and the outputs of the gray shade control circuits 36*a*–36*n* to produce display data to be outputted to the liquid crystal panel 20 and supplies the display data to the column drivers 21. A timing generating circuit 40 supplies timing signals to the A-D converters 31R, 31G, 31B and a row data generating circuit 41. The row data generating circuit 41 supplies simultaneous selection patterns to the row drivers 22. A delay circuit 42 delays the simultaneous selection patterns so that the simultaneous selection patterns to be supplied to the row drivers 22 are in synchronism with display data to be supplied to the column drivers 21.

In FIG. 8, the data selector 34, the arithmetic circuit 37, the timing generating circuit 40, the row data generating circuit 41 and the delay circuit 42 correspond to the controller 23 shown in FIG. 7. Also, the corrector 32, the memories 35*a*–35*n* and the gray shade control circuits 36*a*–36*n* can be included in the controller 23. For simplifying, a single column driver 21 and a single row driver 22 are shown in FIG. 8.

The operation of the liquid crystal panel 21 will be described in more detail. The A-D converters 31R, 31G, 31B are supposed to have a 6-bit output respectively. Namely, the converters convert R, G and B data as analogue signals into digital data of 64 grades of gray shade in accordance with the timing signals from the timing generating circuit 40. The corrector 32 performs a correction treatment such as a γ-correction or the like to each of the digital data, and performs a bit conversion to a requisite number of bits, for instance, 3 bits (8 gray shades). Namely, the 6 bit data are transformed into 3 bit data when the data are corrected to have a linear form with respect to the brightness and the data values of the liquid crystal panel 20. The data after the correction are stored in the display RAM 24.

When the number of the simultaneous selection lines is 7, the number of groups in 480 lines is 480/7=68.57≈69. In this case, the number of memories 35*a*–35*n* to be provided is 69. The data selector 34 distributes the data of 7 lines×640×3 bits which are for the groups, to the memories 35*a*–35*n*. Accordingly, in each of the memories 35*a*–35*n*, data of (simultaneously selected 7 lines)×640×3, i.e. data corresponding to the display area of each group (7×640) of pixels are set. The data of R, G and B are of 3 bits respectively. Namely, there are 7×640×3 bits for R, G and B to each of the display areas. The gray shade control circuits 36*a*–36*n* conduct a gray shade control according to a frame modulation method or a dithering method. For instance, when the frame modulation as shown in FIG. 9 is to be conducted, it is necessary to set data for a plurality of frames in each of the memories 35*a*–35*n*. Then, each of the memories 35*a*–35*n* should have a capacity of several times as large as 7×640×3 bits. Each of the gray shade control circuits 36*a*–36*n* converts 3 bit data for each R, G, B into 1 bit data for each R, G, B according to the frame modulation or the dithering method. Accordingly, each information of 7×640 bits are successively outputted to the display areas of each R, G, B from the gray shade control circuits 36*a*–36*n*.

The arithmetic circuit 37 has such a construction as shown in FIG. 10 for instance. It receives selection data as 7-bit simultaneously selected row selection patterns. FIG. 10 shows a case that [0101010] are inputted as the selection data. The arithmetic circuit 37 receives data on the group to be driven firstly wherein the data are of a 7 row 1 column data (7 bits) when the data of 7×640 are considered as a matrix of 7×640. Each exclusive OR circuit 80 calculates the exclusive OR of the data and the selection data for each bit. Then, four full adders 81 calculate the results obtained by the exclusive OR circuits to obtain an arithmetic sum. The value as a result of the arithmetic sum takes any value of 0 through 7. Accordingly, the results of processing can be expressed by 3 bits. This treatment is executed for each R, G, B. The results of processing 3 bits for R, G, B are supplied to the column drivers 21. Then, the arithmetic circuit 37 conducts the above-mentioned treatment on a 7 row 2 column data, and the result of processing is supplied to the column drivers 21. In the same manner as above, of 7 low m column data (m represents numbers up to 640) are successively processed as described above.

When the treatment of the group to be driven firstly comprising 7 rows and 640 columns is finished, the arithmetic circuit 37 conducts the above-mentioned treatment for the group to be driven next. When the treatment is finished for all the groups, the treatment of 1 frame is finished.

FIG. 11 is a block diagram showing an example of the construction of the column driver 21. The column driver 21 is constituted by a single LSI. In FIG. 11, a data memory 50 stores display data on 64 columns. A shift register 51 is to shift seed signals for writing (start pulses) to designate address locations in the data memory 50. A display latch 53 latches the data in the data memory 50 to supply them to a liquid crystal driving circuit 58 when latch signals (LS) are inputted. A control circuit 52 supplies control signals to the data memory 50, the shift register 51 and the display latch 53. Assuming that the column driver 21 treats the display data on 64 columns, 10 column drivers 21 are needed in order to drive the display panel 20 having 640 pixels per row. The 10 column drivers 21 are cascadedly connected. Namely, an output of the shift register 51 is inputted to the shift register 51 in the column driver of the next stage. Thus, display data from the arithmetic circuit 37 are supplied to the data memory 50 in all the column drivers 21.

The operation of the column driver 21 shown in FIG. 11 will be described. When the control circuit 52 receives an EIO1 signal, it activates the data memory 50, the shift register 51 and the display latch 53. The data memory 50 receives from the arithmetic circuit 37 signals indicative of display data of 3 bits per column for R, G and B, i.e. 9 bits in total. The shift register 51 shifts the start pulses, and the data on 64 stages of the shift register 51 are supplied as addressing signals 54 to the data memory 50. Accordingly, the display data of each of the columns are successively stored at different addressing locations in the data memory 50. When the control circuit 52 confirms that the data on 64 columns have been written in the data memory 50, it outputs an EIO2 signal to the column driver 21 of the next stage. The next stage column driver 21 receives the EIO2 signal from the former stage, as the EIO1 signal.

The column driver 21 of the next stage, when it has received the EIO1 signal, takes the display data on 64 columns by performing the same operation as the column driver 21 of the former stage. Latch signals are inputted to the column drivers at the same timing of the inputting of the display data to the column drivers 21. Then, the display data stored in the data memory 50 in each of the column drivers 21 are latched by the display latch 53, whereby the display data of 640×3 dots are supplied to ten liquid crystal driving circuits 58.

Each of the display data is composed of 3 bits. Each of the liquid crystal driving circuits 58 includes a decoder and a level shifter. Further, voltages of 8 levels V0–V7 are inputted to the liquid crystal driving circuit 58, and the circuit 58 decodes the data of 3 bits per dot from the display latch 53. Also, the liquid crystal driving circuit 58 selects voltages corresponding to decoded values and applies the voltages to the liquid crystal display elements. A single liquid crystal driving circuit 58 produces a 3 (for each dot for R, G and B)×64 (which correspond to the number of pixels)=192 number of outputs to the liquid crystal display panel 20. Accordingly, the liquid crystal display panel 20 receives a 192×10=1,920 number of outputs. Each of the outputs assumes any voltage value among the voltages V0–V7.

The above-mentioned description concerns a case of using the column drivers 21 to a STN color liquid crystal panel. However, column drivers for a TFT (thin film transistor) liquid crystal panel can be used for the column drivers 21. Further, the memory 50 and the shift register 51 may be replaced by shift registers for R, B and B.

FIG. 12 is a block diagram showing an embodiment of the construction of each of the row drivers 22. The row driver 22 is constituted by a single LSI. In FIG. 12, a shift register 70 shifts data SPDI (selection data) by shift clocks DSCK. A selection pattern register 72 takes the selection data in response to load signals LOAD. A shift register 74 shifts frame pulses by using the load signals LOAD as shift clocks. A liquid crystal driving circuit 75 applies the selection data set in the selection pattern register 72 to the row electrodes.

The operation of the row driver 22 will be described in more detail in a case that the selection pattern shown in FIG. 13 in which a multiplex line simultaneous selection method as disclosed in U.S. Pat. No. 5,262,881 is used.

Supposing that the row driver 22 shown in FIG. 12 produces 84 outputs, it is necessary to provide a 480/84≈6 number of row drivers 22 when a liquid crystal display device having 480 scanning lines is used. The row drivers are cascadedly connected. Since the number of row electrodes simultaneously selected is 7, 84 row electrodes are divided into 84/7=12 groups.

For instance, when the selection data on the second column indicated by a dotted circle line "a" in FIG. 13 are serially inputted as the data SPDI to the shift register 70, the shift register 70 shifts the selection ata by the shift clocks DSCK. After 7 shift clocks DSCK have been inputted, load signals LOAD are received. Then, the selection pattern register 72 takes the content of the shift register 70. Accordingly, the selection data composed of parallel signals are set in the selection pattern register 72.

The shift register 74 is of a register having 12 stages. When the row driver 22 is of the first stage in 6 row drivers, frame pulses indicating the top of a frame are inputted as an input IOL, whereby the frame pulses are shifted by using the load signals LOAD as shift clocks. The content of the shift register 74 is supplied as signals for selecting the groups to the liquid crystal driving circuit 75. Further, voltages $V^+$ and $V^-$ to be used at the selection time and a voltage VG (an intermediate voltage between $V^+$ and $V^-$) to be used at the non-selection time are supplied to the liquid crystal driving circuit 75. The liquid crystal driving circuit 75 detects a selected group by decoding inputted signals of the data of the shift register 74. In a case that the first group is selected, the liquid crystal driving circuit 75 supplies voltages in response to the number of bits corresponding to the content of the selection pattern register 72, to 7 row electrodes included in the first group. Namely, a level shift circuit in the liquid crystal driving circuit 75 applies the selection voltage $V^+$ when the corresponding bit is "1", and the selection voltage $V^-$ when the corresponding bit is "0". Each of the row electrodes in the non-selected eleven groups is applied with the non-selection voltage VG. At this moment, the column driver 21 applies to each column electrode the voltages corresponding to the display data which correspond to the selected row electrodes in the same manner as the operation described above.

Then, outputs supplied from the selection pattern register 72 to the liquid crystal driving circuit 75 are successively changed, and selection voltages are applied to each row electrode of each group. When the selection of the groups has been finished for all 12 groups, the frame pulses are forced out as the output IOR of the shift register 74, and the frame pulses are supplied as an input IOL to the row driver 22 of the next stage. The row driver 22 of the next stage performs the same processing as above. Thus, the selection voltages are applied to each of the groups.

Since the conventional liquid crystal driving circuit driven by a multiple line simultaneous selection method has the above-mentioned construction, it has problems as follows.

The display RAM 24 is required as an essential element because there is a difference between the speed of inputted data and the speed of outputted data to the liquid crystal panel 20, and the difference should be absorbed. Generally, data to be inputted are successively fed from the first scanning line to the following scanning lines. In the multiple line simultaneous selection method, however, calculations on column electrodes have to be conducted. Namely, it is necessary to treat simultaneously the display data on the same column in a several number of selection lines. Accordingly, it is necessary to store the data in memories.

Further, memories 35*a*–35*n* are needed in addition to the display RAM 24. In an attempt to use only the memories 35*a*–35*n* while the display RAM 24 is eliminated, the control of addressing wherein the data on the scanning lines successively supplied have to be rearranged to write them in the memories 35*a*–35*n* is complicated, and a large-scaled address control circuit has to be provided.

A commercially available video RAM (V-RAM) can be used for the display RAM 24 and the memories 35*a*–35*n* because it can write in and read out data simultaneously. In the video RAM, however, all the memory regions are not always used, and a waste region may be produced.

In the arithmetic circuit 37 to which the multiple line simultaneous selection method is applied, a high speed of arithmetic calculation is required. For instance, in a case that a display of 40 frames per second is required and 7 lines have to be simultaneously selected for a liquid crystal panel 20 of 640×(R, G, B)×480 dots, the speed of arithmetic operation per dot is:

$$1(\mathrm{SEC})/40(F)\times(7(L)/480(D))/640=569.66\ \mathrm{nsec.}$$

When the selection pattern shown in FIG. 13 is used, the pattern has to be in an alternating current form, and it is necessary to perform arithmetic calculations for all the columns (8 columns) for the selection pattern. As a result, the calculations for each column have to be at a speed of $$569.66/8=71.2\ \mathrm{nsec.}$$

Actually, a further large number of frames have to be supplied to the liquid crystal panel 20 for each second in order to display a dynamic picture such as a driven car or the like. Accordingly, the arithmetic circuit 37 is required to have a further high speed of operation and a transferring speed for the column driver 21.

In order to increase the speed of calculations, a clock signal having a high frequency is required, whereby a power consumption rate is increased from a formula:

$$P=IV=fCV\cdot V.$$

Further, since a large number of memories 35*a*–35*n* having a relatively large capacity are provided for the calculation of the row voltages, the consumption of power is increased. This means that it is difficult to use a driving circuit for the multiple line simultaneous selection method in a small sized portable device.

Further, as described above, since the conventional driving circuit for realizing the multiple line simultaneous selection method inevitably has a large scale and a large number of parts, it is difficult to use it for small-sized portable devices.

SUMMARY OF THE INVENTION

It is an object of the present invention to provide a column electrode driving semiconductor integrated circuit and a row electrode driving semiconductor integrated circuit which can reduce the number of elements such as a memory in a liquid crystal driving circuit, and realizes the reduction of a power consumption rate by lowering the speed of processing.

In accordance with the present invention, there is provided a column electrodes driving semiconductor integrated circuit for driving column electrodes in a liquid crystal display device to be driven by a multiple line selection method, which comprises a memory unit for storing display data and outputting the data on each row electrode in simultaneously selected lines, and an arithmetic circuit unit including an arithmetic processing circuit for receiving the data outputted from the memory unit and selection data indicating a voltage pattern applied to the selected row electrodes and for producing by arithmetic processing information of voltages selected by a select and output circuit unit.

The column electrode driving semiconductor integrated circuit as an aspect of the present invention, is suited for a liquid crystal display device driven by a multiple line selection method wherein the number of simultaneously selected lines is any one of 2 through 15; the control circuit of the memory unit outputs data on 2 lines through 15 lines, and the arithmetic processing unit of the arithmetic circuit unit performs arithmetic processing on the selection data of 2 bits through 15 bits and the data outputted from the memory unit.

The column electrode driving semiconductor integrated circuit as another aspect of the present invention has a correction unit which conducts a γ-correction or a gray shade treatment on the data inputted, and writes the treated data in the memory unit.

In an aspect of the present invention, the column electrode driving semiconductor integrated circuit comprises the memory unit which has a capacity of memorizing a plurality of bits for a dot, and outputs a bit or bits in response to a selection signal by means of the control circuit.

Further, in the column electrodes driving semiconductor integrated circuit as another aspect of the present invention, the control circuit of the memory unit outputs data on a plurality of columns at a time, and the arithmetic circuit unit has an arithmetic processing circuit for processing data on a plurality of column electrodes which are read out from the memory unit at a time.

As another aspect of the present invention, the row electrode driving semiconductor integrated circuit is a semiconductor integrated circuit adapted to drive row electrodes in a liquid crystal display device driven by a multiple line selection method, which comprises row drivers and a row electrode pattern generating circuit.

The driving device as another aspect of the present invention is a device adapted to drive column electrodes in a liquid crystal display device driven by a multiple line selection method, wherein there are a plurality of column electrode driving semiconductor integrated circuits each of which has an arithmetic circuit unit which receives selection data indicating voltage patterns to be applied to the selected row electrodes and display data on the selected row electrodes to conduct arithmetic processing whereby information designating voltages selected by a select and output circuit unit is produced.

The column electrode driving semiconductor integrated circuit according to the present invention can directly receive data for display supplied in a digital form. Namely, the data for display are written in the memory unit of the integrated circuit according to instructions from an external controller, and a control circuit in the memory unit successively or simultaneously reads out and outputs the data on each row in the simultaneously selected lines. The arithmetic processing circuit of the arithmetic circuit unit in the integrated circuit receives selection data, performs arithmetics operation of the selection data and data outputted from the memory unit, and calculates to obtain voltage levels to be applied to each of the simultaneously selected rows. The integrated circuit can receive directly the data for display in a digital form to determine voltage levels to be applied to row electrodes according to the multiple line selection method.

The semiconductor integrated circuit as an aspect of the present invention can realize a column electrode driving circuit in a driving circuit to which a multiple line selection method selecting simultaneously 2 lines-15 lines is applied. Namely, a control circuit in the memory unit of the integrated circuit successively or simultaneously reads out the data on each row in selected 2 through 15 lines, and outputs the data. The arithmetic circuit unit performs operation of the data for 2 through 15 lines for each column.

The semiconductor integrated circuit as another aspect of the present invention includes a circuit unit performing a γ-correction or a gray shade display treatment whereby the scale of the liquid crystal driving circuit can be further reduced.

As another aspect of the present invention, the semiconductor integrated circuit can store the data of a plurality of bits for a dot to be displayed, and can select any number of bits to be outputted. Accordingly, a gray shade control by a dithering method or a frame modulation method can be easily obtainable by selecting memory units.

In the semiconductor integrated circuit as another aspect of the present invention, since the arithmetic circuit unit has a plurality of arithmetic processing units, operations for a plurality of columns can be performed at a time whereby the frequency of driving clocks can be reduced.

The semiconductor integrated circuit as another aspect of the present invention includes a circuit for forming a row electrode selection pattern whereby the scale of a liquid crystal driving circuit can be reduced.

In the driving device as another aspect of the present invention, a plurality of arithmetic circuit units are provided to drive the column electrodes. Accordingly, each of the arithmetic circuit units can operate at a relatively low operational speed.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein:

FIG. 9 is a diagram for illustrating frame modulation;

FIG. 10 is a block diagram showing an example of construction of an arithmetic circuit;

FIG. 13 is a diagram showing an example of a row selection pattern of 7 rows and 8 columns.

DETAILED DESCRIPTION OF THE PREFERRED EMBODIMENTS

Figure 1:
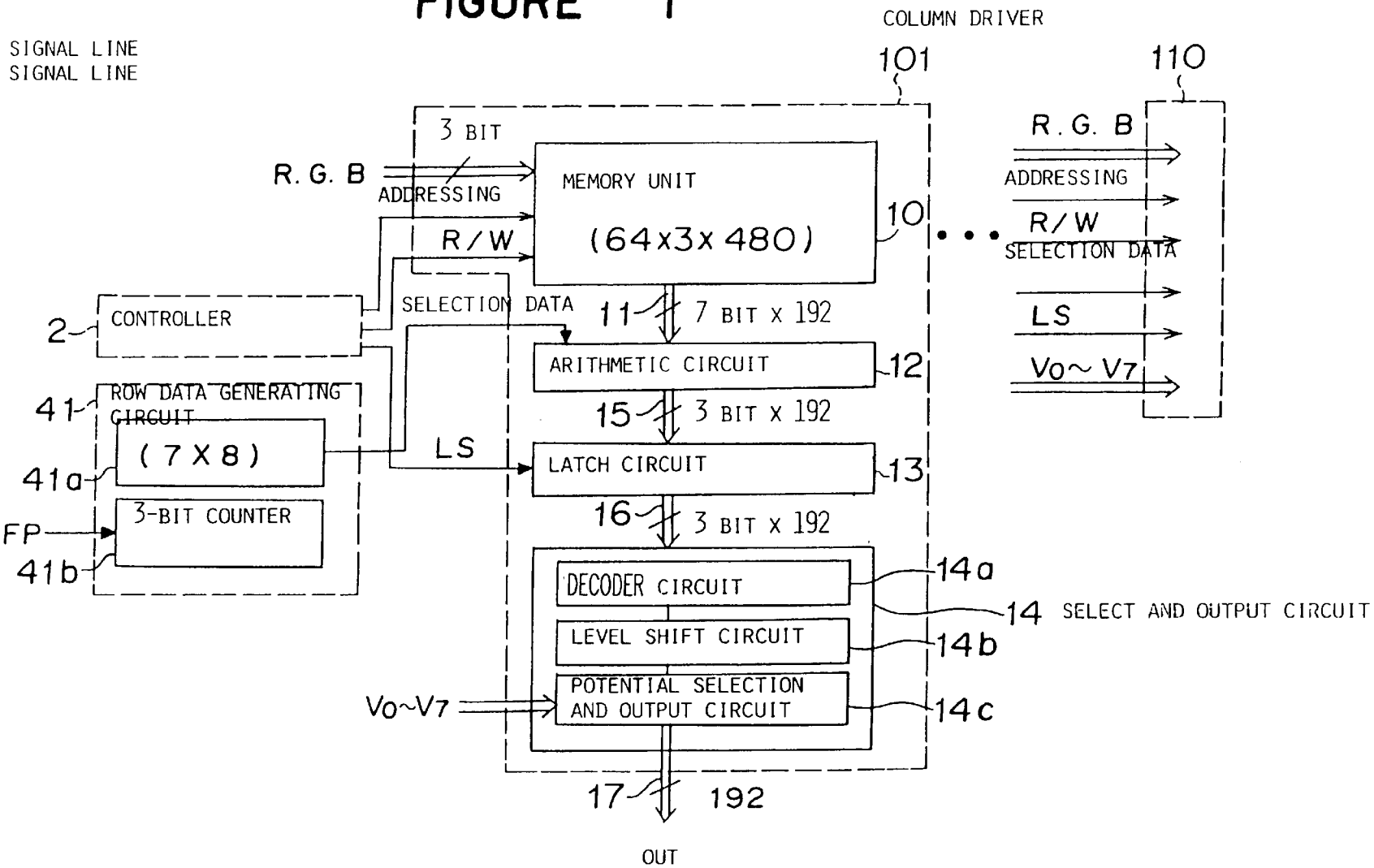
FIG. 1 is a block diagram showing an embodiment of the column electrode driving semiconductor integrated circuit driven by a multiple line selection method according to the present invention.

The present will be described in more detail with reference to the drawings wherein the same reference numerals designate the same or corresponding parts.

EXAMPLE 1

FIG. 1 is a block diagram showing a column driver 101 driven by a multiple line selection method according to a first embodiment of the present invention. In FIG. 1, there are also shown a controller 2 for supplying control signals to the column driver 101 and a row data generating circuit 41. The column driver 101 is composed of a LSI. The column driver 101 includes a memory unit 10 in which display data are written, a signal line 11 for feeding column data to a liquid crystal display panel 20, an arithmetic circuit unit 12 for receiving selection data from the row data generating circuit 41 and the column data from the signal line 11 to perform predetermined operations, a latch circuit 13 for receiving outputs from the arithmetic circuit unit 12 through a signal line 15 to latch the outputs, and a select and output circuit 14 for receiving the latched data through a signal line 16 and outputting voltages corresponding to the latched data to an output line 17. The output line 17 is connected to column electrodes in the display panel 20. The column driver 101 is supposed to take charge of 64 pixels among 640 pixels. In this case, 10 column drivers 101–110 are provided in the liquid crystal display device. The column drivers 101–110, in comparison with the conventional driving circuit shown in FIG. 8, functions as the display RAM 24, the data selector 34, the memories 35*a*–35*n*, the arithmetic circuit 37 and the column driver 21.

FIG. 1 shows the controller 2 and the row data generating circuit 41 which are not included in the column driver (LSI) 101. The row data generating circuit 41 has a ROM 41*a* storing a row selection pattern shown in FIG. 13 for instance, and a counter 41*b* which counts frame pulses or frame synchronizing signals, and supplies the count values as addressing signals, to the ROM 41*a*. In this embodiment, the row data generating circuit 41 is not included in the column driver (LSI) 101. However, the row data generating circuit 41 may be included in the column driver 101.

The operation of the column driver 101 will be described. In this example, the column driver 101 is supposed to receive data of 1 bit per pixel for R, G and B respectively. In a case that the data are successively inputted according to the order of lines, the controller 2 controls addressing signals and writing signals to write the data in the memory unit 10 of the column driver 101 when the data of the first pixel through the 64th pixel on each scanning line are inputted. Similarly, when the data on (640-63)th pixel through the 640th pixel are inputted, the controller 2 controls addressing signals and writing signals to write the data in the memory unit 10 of the column driver 110. Thus, the data of 1 frame are written in ten memory units 10 in the whole.

When the data are read out from the memory unit 10, the controller 2 controls addressing signals and read signals so that the data are supplied to the arithmetic circuit unit 12 from each of the memory units 10 in the column drivers 101–110. The data to be outputted are the data for 64 pixels in the simultaneously selected row electrodes (for instance, 7 row electrodes), i.e. the data of 64×3×7 bits.

Figure 12:
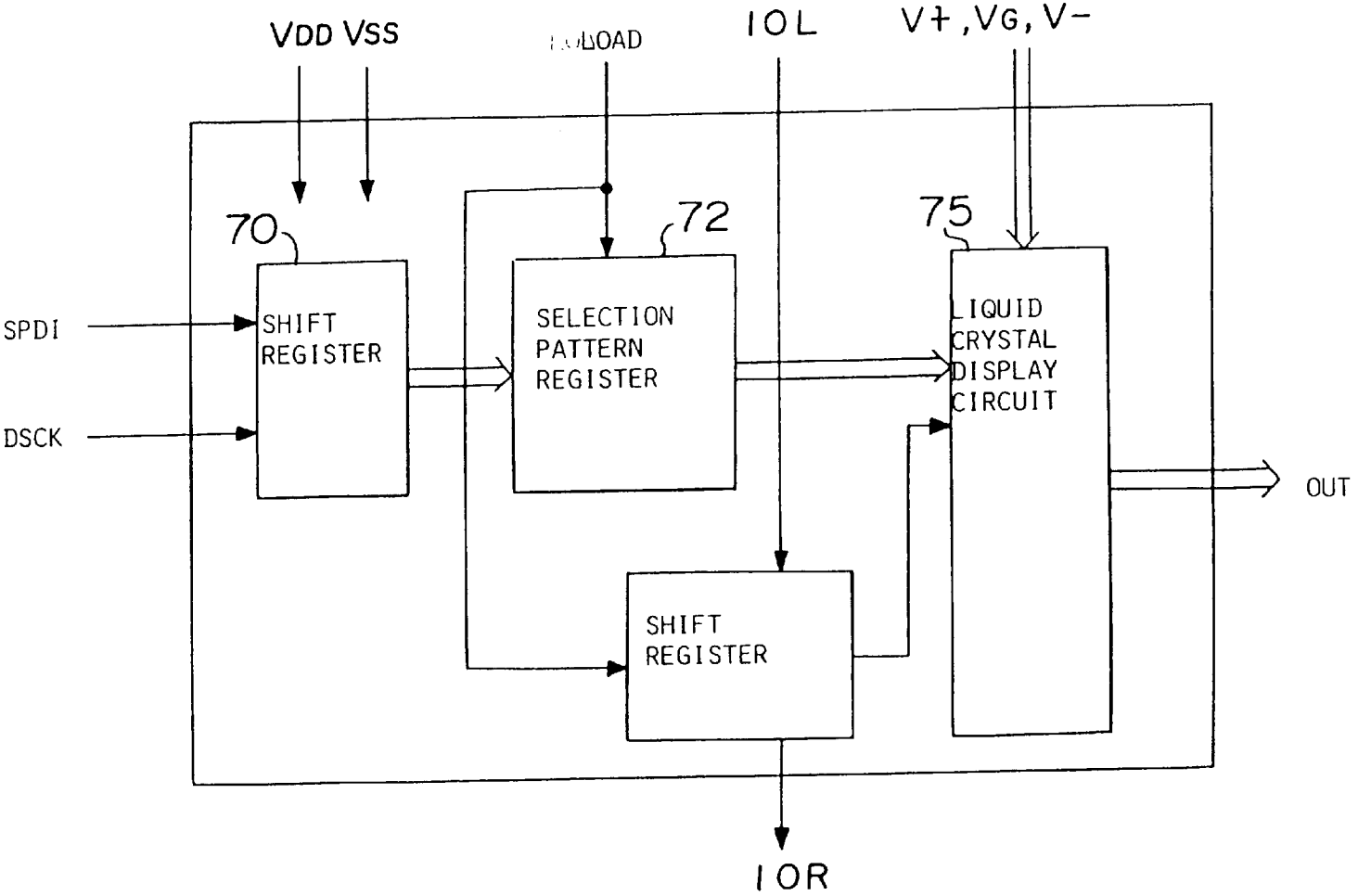
FIGURE 12 PRIOR ART
FIG. 12 is a block diagram showing an example of construction of a conventional row driver.

In order to facilitate the reading-out operations, an address decoder for writing is provided separate from an address decoder for reading in the memory unit 10. For instance, when the address decoder for reading subsequently selects memory cells in response to addressing signals for writing, the address decoder for reading selects a memory cell in which the data of 7 rows in the firstly selected group (the data of 64×3 bits for each of the rows) are stored, in response to the firstly supplied address signal. In this manner, a memory cell in which the data on 7 rows in the finally selected group are stored, is selected in response to the 69th address signal. The reason why the 69th signal is finally applied, is because 480/7≈69. The read signals are in synchronism with the timing of generating load signals LOAD in FIG. 12.

Accordingly, each time when a series of selection data is supplied from the row data generating circuit 41, the data of 64×3×7 bits are simultaneously outputted from each of the memory units 10. Although the arithmetic circuit unit 12 has the construction as shown in FIG. 10, a 64×3 number of circuits as shown in FIG. 10 are provided in the arithmetic circuit unit 12. Accordingly, the arithmetic operations for the data of 64 pixels are executed at once. Since the arithmetic circuits 12 in the ten column drivers 101–110 perform simultaneously arithmetic operations, the operations of data for 7 lines×640 pixels are executed at once. In the conventional arithmetic circuits 37 shown in FIG. 8 executed arithmetic operations on the data of 7 lines×1 pixel for each column.

In the conventional driving circuit, the display RAM 24 and each of the memories 35*a*–35*n* had respectively a memory element, i.e., a V-RAM. Accordingly, each of the memories 35*a*–35*n* was obliged to set data in a form of 7 lines×640 pixels (7 rows×640 columns). Although it is desirable that data be formed in each of the memories 35*a*–35*n* so that the data of 7 pixels of the same column can be directly and simultaneously read out in the same manner as the present invention, it is difficult to form the data as far as the commercially available V-RAM is used. In order to form such data, a complicated and large-scaled address control circuit is necessary as described before. Further, even though some elements for reading the data (e.g., the gray shade control circuits 36*a*–36*n* in FIG. 8) can directly and simultaneously read the data for 7 pixels on the some column from the memories 35*a*–35*n*, it is necessary to successively read out the data for 640 columns. Accordingly, there was no way for the arithmetic circuit 37 other than the operations of successive treatment.

On the other hand, in the present invention, the address decoder for reading in the memory unit 10 formed of a LSI can be so constructed that the data for 7 pixels on the same column can be directly read out and the data for 64 columns can be read out. Accordingly, the arithmetic circuit unit 12 in this embodiment can treat the data for each 7 pixels on 64 columns. In this embodiment, since there are 10 arithmetic circuits 12 in the column drivers 10, the speed of arithmetic calculation required for each of the arithmetic circuits 12 can be 1/640 as fast as the speed of arithmetic calculation of the conventional arithmetic circuit 37. Accordingly, the frequency of clocks for driving the arithmetic circuits 12 can be low, whereby the power consumption rate of the arithmetic circuits 12 can be low.

Figure 2:
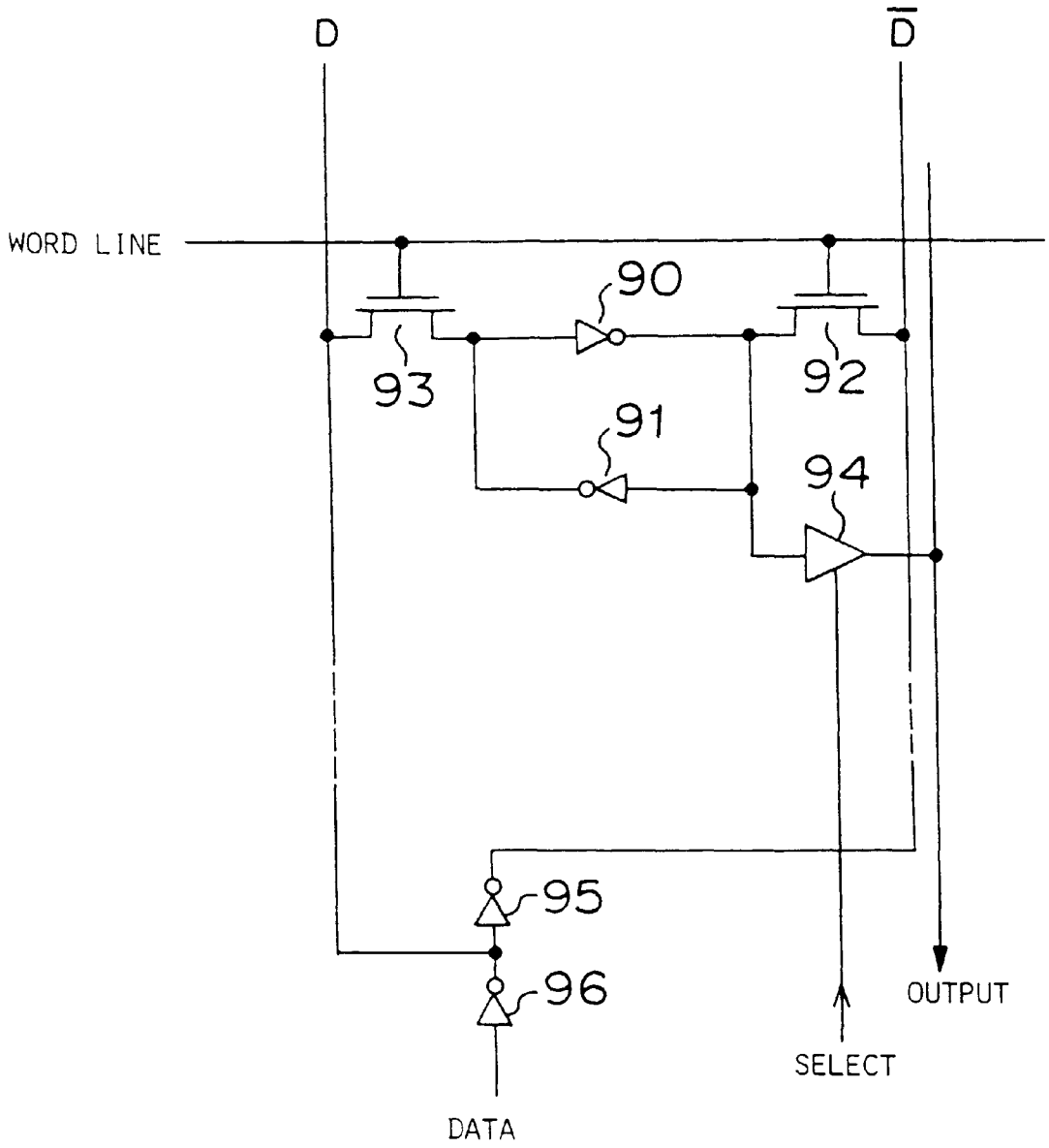
FIG. 2 is a circuit diagram showing a RAM cell as an embodiment of a memory cell.

FIG. 2 is a circuit diagram of a RAM cell as an example of a memory cell in a memory array in the memory unit 10. In FIG. 2, inverters 90, 91 constitute memory elements. When data are written in the memory elements, data signals are applied to data signals, and at the same time, a word line is made active. The data on the data signals are supplied to a data line D through an inverter 96, and a data line $D^-$ through an inverter 95. The memory elements are connected with transistors 92, 93 whose gates are connected to the word line and whose drains are connected to the data lines D, $D^-$. When data are to be written in the memory elements, the transistors 92, 93 become in a conductive state. When the data are read out, a select signal as an active signal is given to a driver 94 whereby it becomes in a conductive state. Accordingly, the data stored in the memory elements are outputted to an output line. Namely, the data are outputted to a port different from the data lines D, $D^-$. Accordingly, it is unnecessary to pre-charge the data lines, which is required when data are read out from the RAM cell, and the data can be read out at any time.

Figure 3:
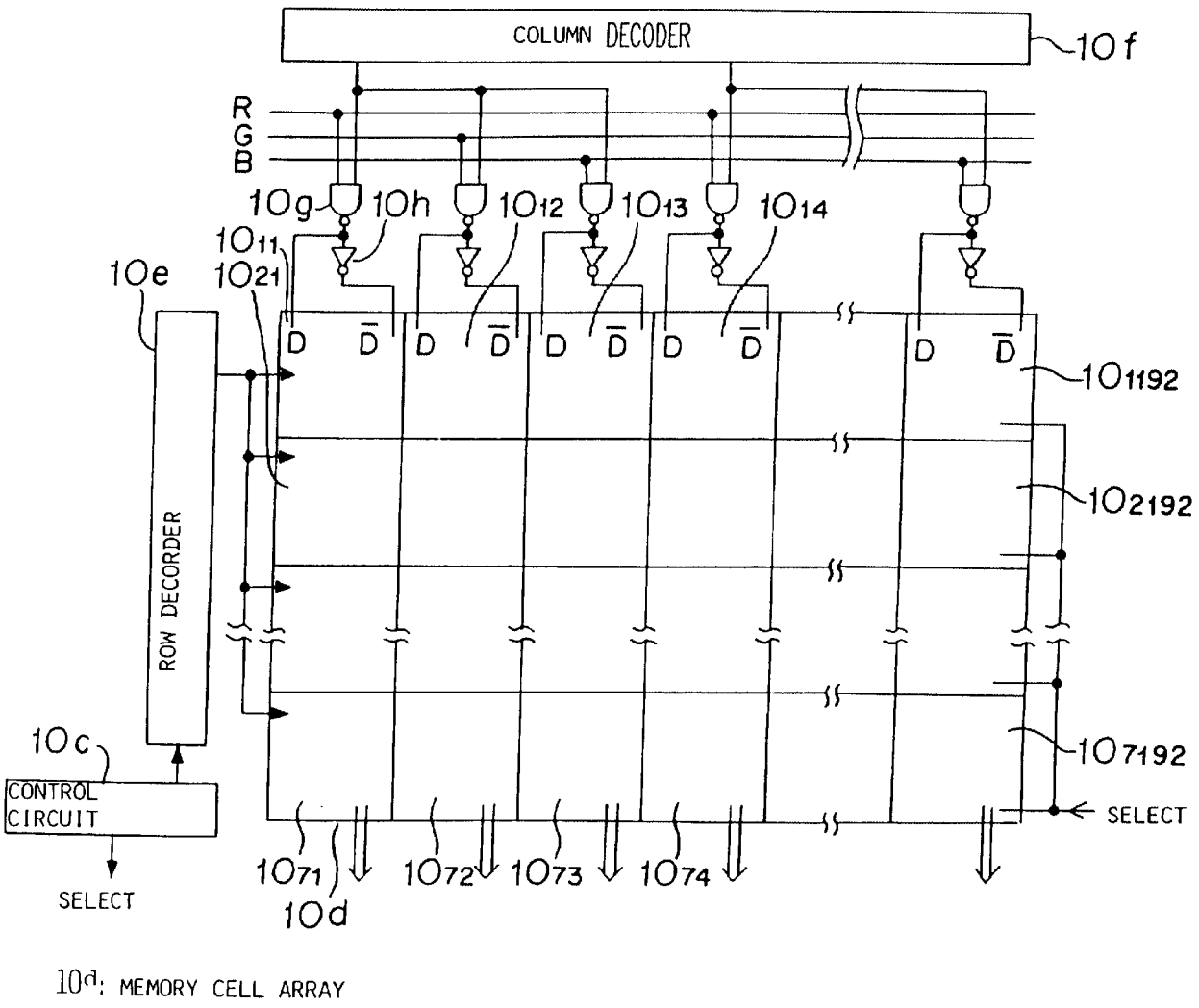
FIG. 3 is a block diagram showing an embodiment of a memory unit used for the present invention.

FIG. 3 is a block diagram showing an embodiment of the memory unit. In FIG. 3, a memory cell array 10*d* has a 64×3×7 number of memory cells $\mathbf{10}_{11}$–$\mathbf{10}_{1192}$ . . . $\mathbf{10}_{71}$–$\mathbf{10}_{7192}$. The writing of data in the memory cells is effected as follows. A row decoder 10*e* selects a row comprising a plurality of memory cells in response to an address input. A column decoder 10*f* selects a memory cell among the plurality of memory cells in the selected row, in response to an address input. The data for any of R, G and B are written in the selected memory cell. A NAND circuit 10*g* and an inverter 10*h* respectively correspond to the inverters 96, 95 in FIG. 2. The reading of data from the memory cells is effected as follows. A control circuit 10*c* outputs a select signal in response to an address input for reading-out. The memory cells are connected to each other so that the data are outputted from each group of 7 cells comprising [$\mathbf{10}_{11}$, $\mathbf{10}_{21}$ . . . , $\mathbf{10}_{71}$], . . . and 7 cells comprising [$\mathbf{10}_{1192}$, $\mathbf{10}_{2192}$ . . . , $\mathbf{10}_{7192}$] in response to the select signals.

The latch circuit 13 in each column driver composed of a LSI is so constructed as to latch display data of 64×(R, G, B) bits outputted from the arithmetic circuit unit 12 when it is supplied with a latch signal LS from the controller 2. Namely, the latch circuit 13 latches the display data in the same manner as the conventional display latch 53.

A liquid crystal driving circuit 14 has a 64×(R, G, B) number of output lines to which 8 voltage levels V0–V7 are supplied inputs. Any of the voltage levels is selected in response to output values from the latch circuit 13, and the selected voltage levels are outputted through output lines. Namely, the same treatment as the conventional liquid crystal driving circuit 58 is effected. Specifically, as shown in FIG. 1, the select and output circuit 14 has a decode circuit 14*a* for decoding data of 3 bits, a level shifter circuit 14*b* for converting the logical circuit voltage levels of decoded values (0, $V_{DD}$) into liquid crystal driving source voltages (0, $V_{EE}$), and a potential selection output circuit 14*c* which receives the voltage levels V0–V7 to select any of V0–V7 as a gate signal by using the output of the level shifter circuit 14*b*.

Figure 11:
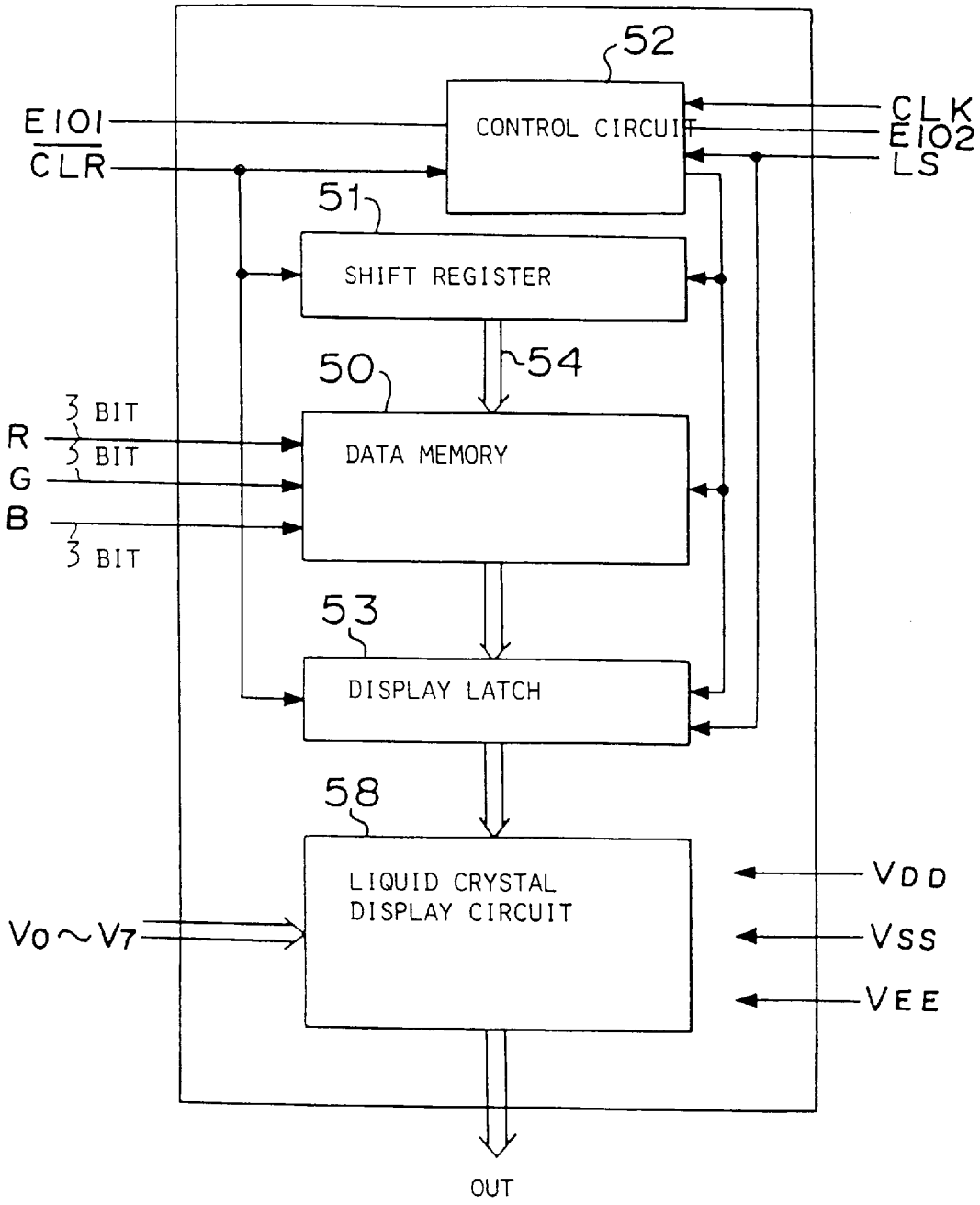
FIGURE 11 PRIOR ART
FIG. 11 is a block diagram showing an example of construction of a conventional column driver.

In this embodiment, description is made as to the case that a 192 number of circuits as shown in FIG. 10 are used in each of the arithmetic circuits 12. However, the circuit can be replaced by a single circuit by which successive arithmetic calculations are performed, if driving clocks having a relatively high frequency can be used. Further, the data memory 50 as shown in FIG. 11 or a latch circuit may be provided between the memory unit 10 and the arithmetic circuit 12 so that the data are once stored in the data memory, and then the data are supplied to the arithmetic circuit 12.

EXAMPLE 2

Figure 4:
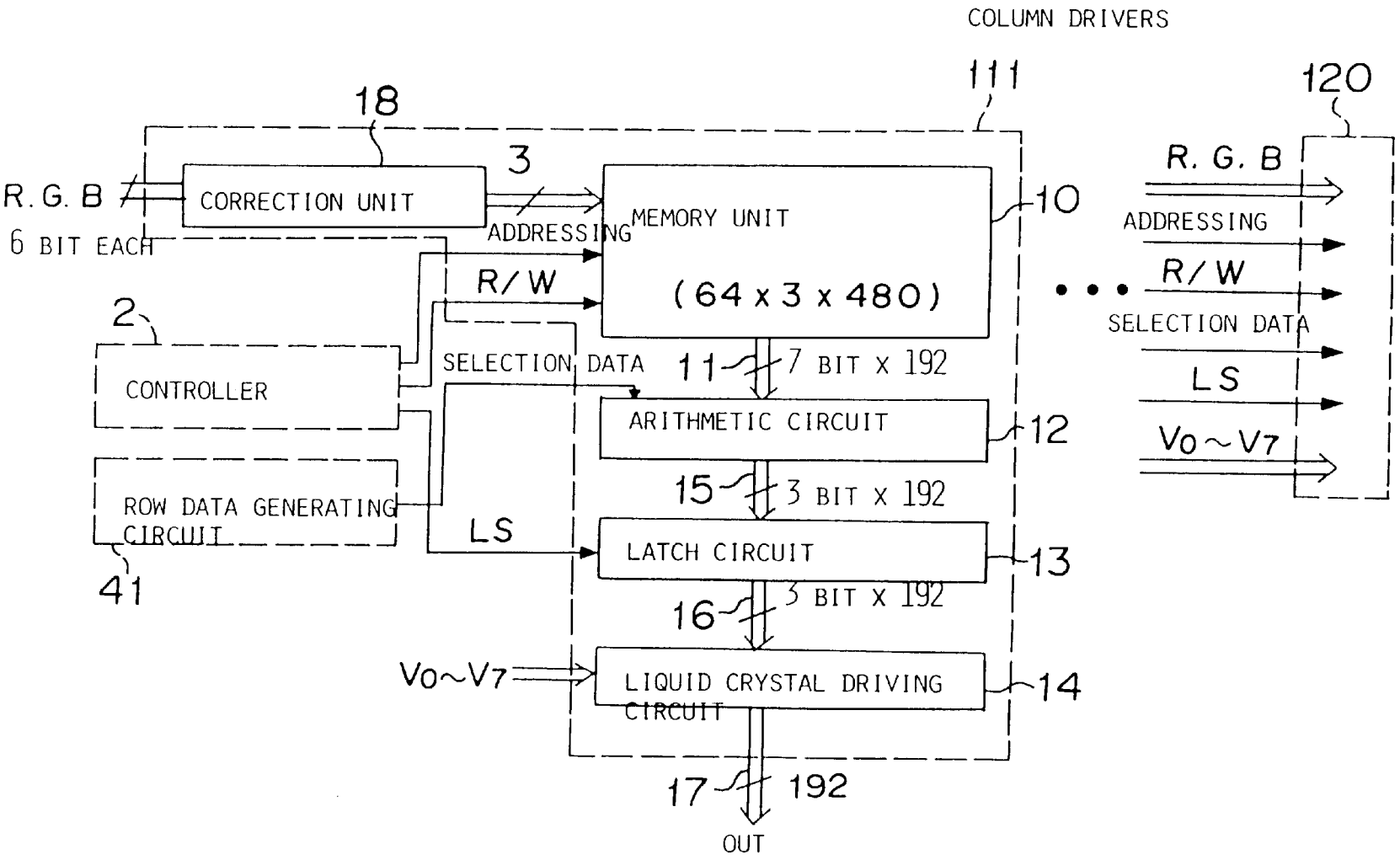
FIG. 4 is a block diagram showing a second embodiment of the column electrode driving semiconductor integrated circuit driven by a multiple line selection method according to the present invention.
Figure 8:
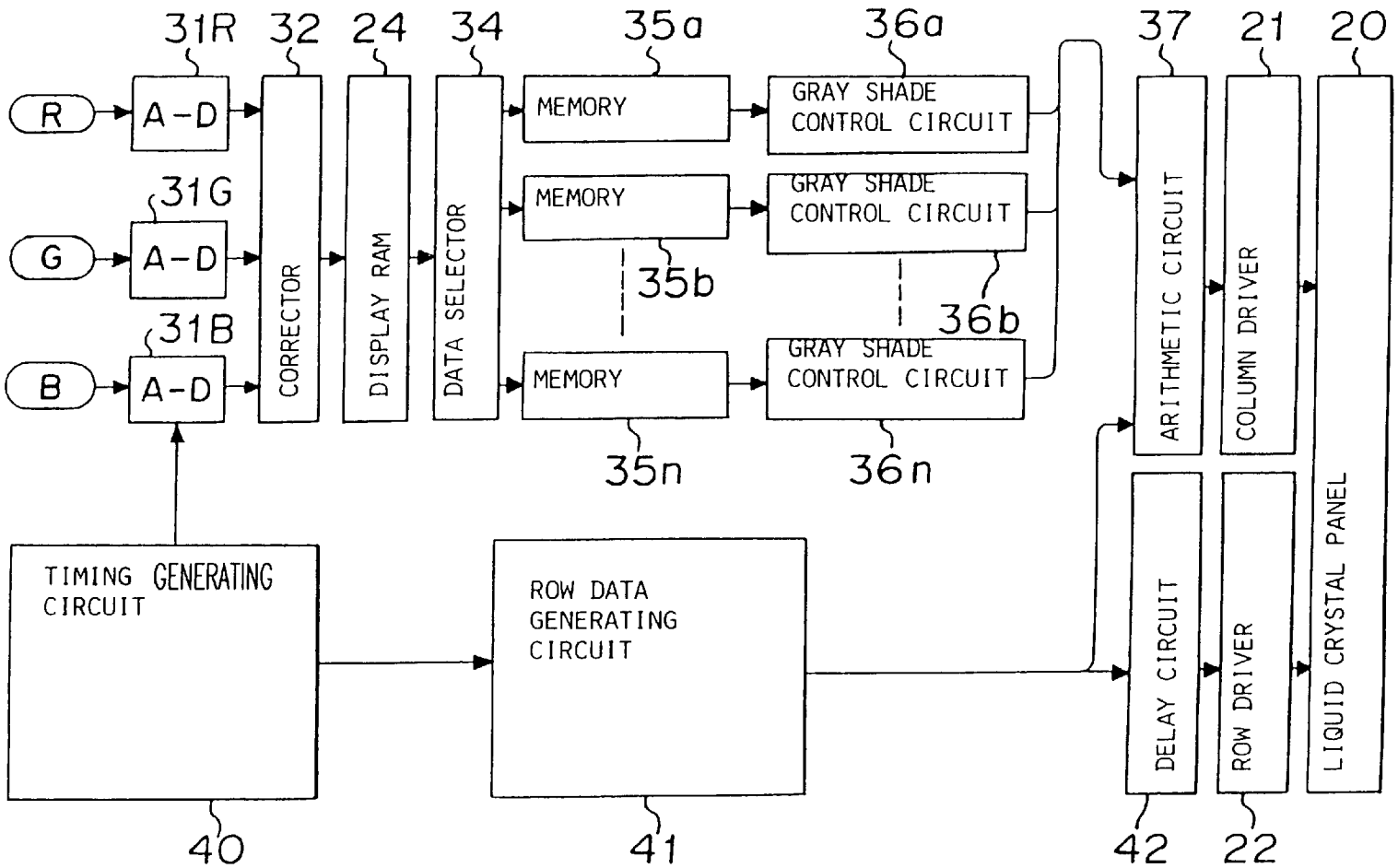
FIGURE 8 PRIOR ART
FIG. 8 is a block diagram showing the construction of a driving circuit in a conventional liquid crystal display device.

In the first example, each of the LSIs does not contain a circuit for correction or gray shade control so that the relation between the brightness and the data values can be expressed in a linear line. In order to realize such relation, column drivers 111–120 each including a correction unit 18 as shown in FIG. 4 can be provided, for instance. The correction unit 18 receives the data of 6 bits per pixel for each of the R, G and B from the A/D converters 31R, 31G and 31B which are shown in FIG. 8, for instance. The correction unit 18 conducts a γ-correction to the input data to form data of 3 bits for each R, G, B. Since the γ-correction is a data conversion, it is easy to form the portion for executing the data conversion in a form of LSI. For instance, the portion for executing the data conversion can be realized by a ROM unit which stores a data table and a unit of reading-out the data in the ROM unit upon receiving an input data. Further, the correction unit 18 converts the 3-bit data for each of R, G and B (8 gray shade each) into data of 1 bit for each by using a dithering method. The data conversion can also be easily realized with a ROM unit storing a data table and a comparator or the like. Further, correction unit 18 may have either function of the γ-correction or the gray shade control by using the dithering method.

The data of 1 bit per pixel for each of R, G and B, i.e. 3 bits in total, are written in the memory unit 10 in the same manner as the first example. Then, the column drivers 111–120 operate in the same manner as the column drivers 101–110 of the first example.

EXAMPLE 3

Figure 5:
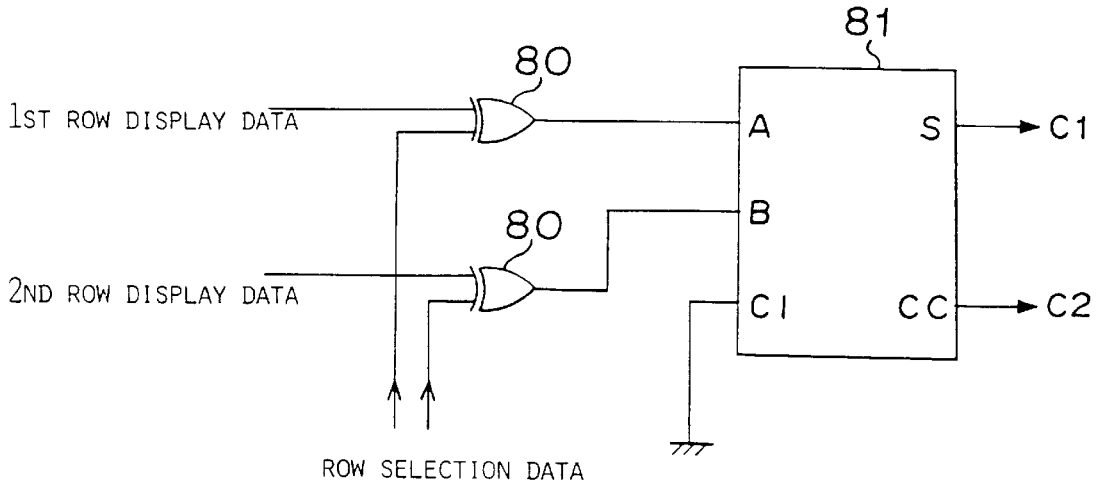
FIG. 5 is a circuit diagram showing an arithmetic circuit unit used for the column electrode driving semiconductor integrated circuit according to a third embodiment of the present invention.

FIG. 5 is a circuit diagram showing the construction of an arithmetic circuit unit 12 applicable to the column drivers in accordance with the third example of the present invention. The construction of each of the column drivers is generally the same as that shown in FIG. 1 or FIG. 4. The arithmetic circuit unit 12 comprises a 64×3 (R, G, B)=192 number of units which correspond to number of columns in charge of a single column driver, for instance. The arithmetic circuit unit 12 may have a single circuit shown in FIG. 5.

FIG. 5 shows a case that the number of simultaneously selected lines is 2. Accordingly, when the arithmetic circuit unit 12 has a 192 number of circuits, the number of lines 11 connecting the memory unit 10 to the arithmetic circuit unit 12 can be 2×192. There are three levels of voltage V0, V1, V2 as selection voltages which are supplied to the liquid crystal driving circuit. Exclusive OR circuits 80 in the arithmetic circuit unit 12 take the exclusive OR of the data on two lines supplied from the memory unit 10 and selection data. A total adder 81 outputs the sum of values from the two exclusive OR circuits 80. The output value of the total adder 81 is any of "0", "1" and "2". The latch circuit 13 operates in the same manner as that in the first example or the second example. The liquid crystal display circuit 14 applies a voltage V0, V1 or V2 to 192 output lines in response to the outputs of the latch circuit 13.

In this example, the maximum value of voltage supplied from the liquid crystal driving circuit 14 to the liquid crystal panel 20 can be 5V or less. When the maximum difference of the output voltages (peak to peak) of the column driver is VC, the maximum difference of the output voltages of the row driver is VR, the threshold voltage of liquid crystal is T, the number of scanning lines in the liquid crystal panel 20 is N and the number of simultaneously selected lines is L, the following formulas are obtainable:

$$VR=T((2\times N/L)/(1-N^{-1/2}))^{1/2} \text{ and}$$

$$VC=R\times L/N^{1/2}$$

Accordingly, when L=2, T=2V and N=480, then, VR=44.85V and VC=4.09V.

Further, when L=3, T=2V and N=480, then, VR=36.62V and VC=5.01V. Even in this case, the maximum value can be substantially about 5V.

Further, when L=15, T=2V and N=480, then, VR=16.39V and VC=11.211V.

From the above-mentioned formulas, when L=2 or 3, the maximum voltage value to be treated by the column driver can be about 5V. Accordingly, when the column driver is formed of an LSI, the column driver can be prepared by using a generally used 5V process. Then, the number of processes such as photo-resist, light exposure, etching and so on can be reduced in comparison with a column driver operable with a high voltage. In particular, since the column driver can be prepared with use of the 5V process, the memory unit 10 can be prepared with the same process as a generally used process for a D-RAM. Accordingly, the manufacturing cost and the size of the memory unit 10 can be reduced.

Further, when the number of simultaneously selected lines is L=2 or 3, the number of voltage levels used for the liquid crystal driving circuit 14 can be as small as 3 or 4. Accordingly, the size of the liquid crystal driving circuit 14 can be reduced, whereby the size of the LSI is reduced.

When the number of simultaneously selected lines is increased, the contrast ratio of the display can be improved. However, it is known that the degree of improvement is saturated with about L=15 in a case that 480 scanning lines in total are reduced to about half, i.e., 240. Therefore, the value of L is selected from the values ranging from 2 to 15 in consideration of the performance of the liquid crystal panel 20, the size of LSIs, restrictions to the power source voltage and so on.

EXAMPLE 4

Figure 6:
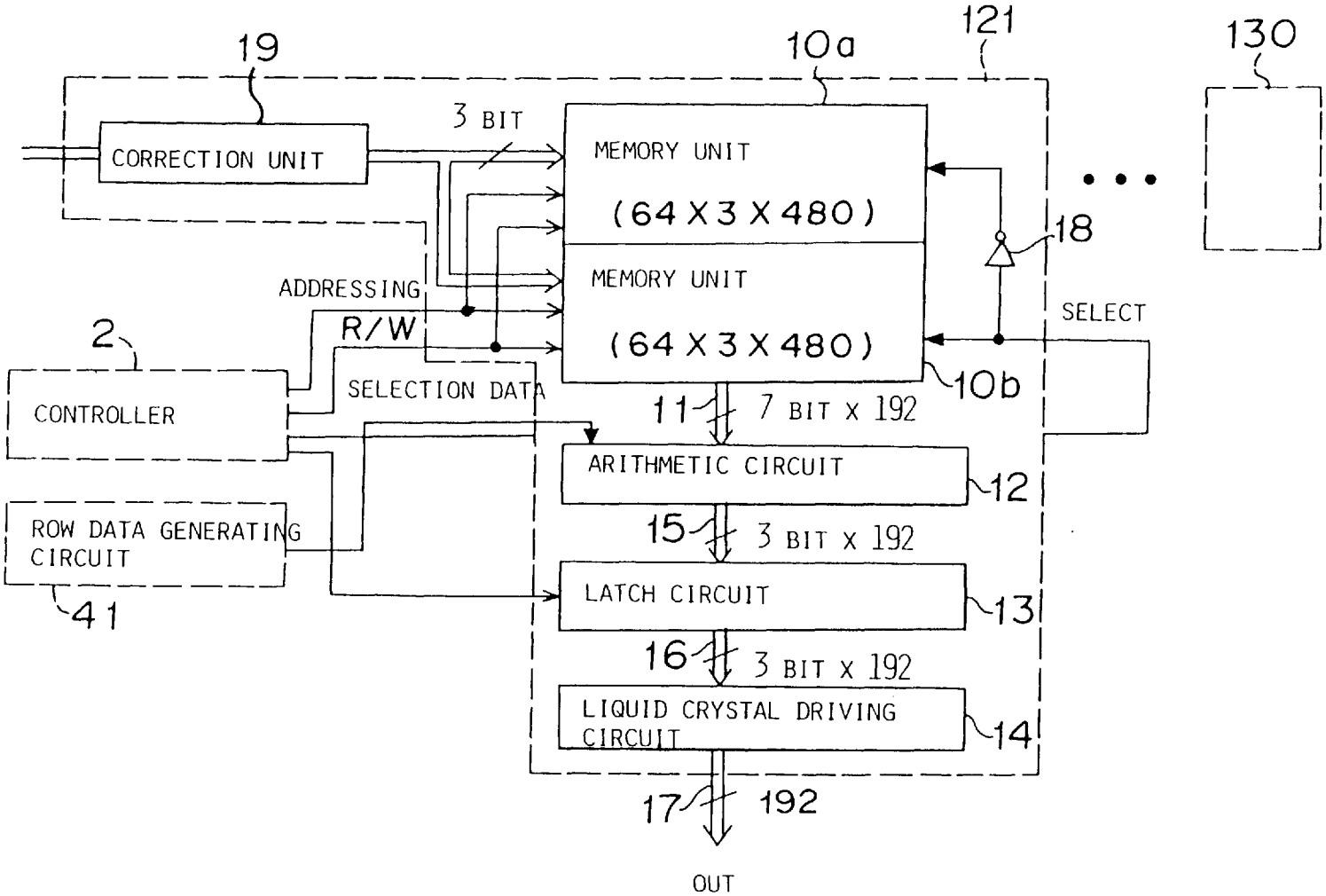
FIG. 6 is a block diagram showing the column electrode driving semiconductor integrated circuit driven by a multiple line selection method according to a fourth embodiment of the present invention.
Figure 7:
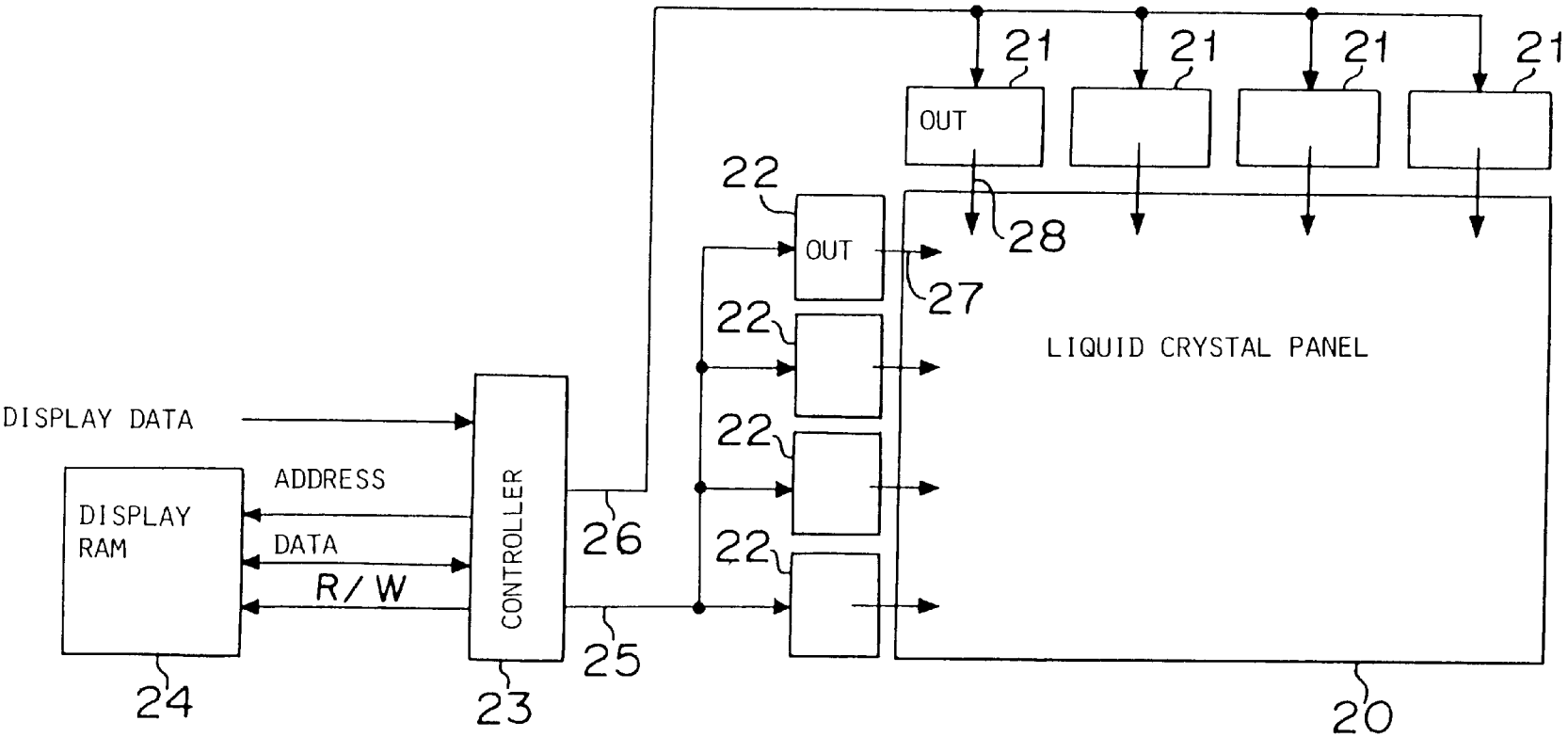
FIGURE 7 PRIOR ART
FIG. 7 is a block diagram showing a conventional liquid crystal display device.

FIG. 6 is a block diagram showing the construction of a column driver 121 according to the fourth example of the present invention. The column driver 121 is also formed of a LSI. In the second example, the dithering method is used for gray shade control. However, the column driver 121 is to realize the gray shade control by a frame modulation method.

In FIG. 6, a correction unit 19 performs a γ-correction, and outputs a corrected value in a form of binary a cord signal. In the column driver 121, there are two memory units 10*a*, 10*b*. The construction of the memory units 10*a*, 10*b* may be the same as that of the memory unit 10 shown in FIG. 1. The memory units 10*a*, 10*b* are supplied with the same address signals and the same read/write signals. The data of a frame supplied from the correction unit 19 are written in the memory unit 10*a*. Then, the data of the next frame are written in the memory unit 10*b*. The data of the further next frame are written in the memory unit 10*a*. Thus, the control of the writing operations is conducted by the controller 2. For instance, wires may be arranged so that the controller 2 can supply enable signals whereby either of the memory units to be written is rendered to be an enable state by the controller 2.

As shown in FIG. 9, when the data of a first frame are in an ON state and the data of a second frame are OFF on a certain dot, the dot having a half tone can be displayed to an observer who watches the liquid crystal panel 20. Accordingly, when the memory units 10*a*, 10*b* have the data for two frames, a frame modulation to present an intermediate concentration dot can be provided by means of the controller 2. Namely, the controller 2 performs an address signal control and a read signal control as in the first example when the data are outputted from the memory units 10*a*, 10*b*. Then, a selection signal SELECT is to change one of the memory units to the other. For instance, when the data of a frame stored in the memory unit 10*a* is read out, the polarity of the selection signal SELECT is changed when the data in the memory unit 10*b* becomes necessary. The selection signal SELECT functions as a signal for rendering the address decoders in the memory units 10*a*, 10*b* to become an enable state. Accordingly, at the time when the polarity of the selection signal SELECT has been changed, the data in the memory unit 10*b* is supplied to the arithmetic circuit 12.

The subsequent operations are the same as the case of the first example. In this example, however, the display data after having subjected to the gray shade control can be supplied to the arithmetic circuit 12.

This example concerns a case of the provision of two memory units 10*a*, 10*b*. However, three or more memory units may be provided. Further, in this example, description has been made as to a case that the memory units 10*a*, 10*b* store the display data of different frames in which each dot is indicated by a bit. However, the memory units 10*a*, 10*b* may store the display data of a frame in which each dot is expressed by a plurality of bits, i.e., providing a gray shade. In this case, the correction unit 19 performs only the γ-correction, and does not have a portion conducting a binary cord treatment. Even in this case, it is possible to supply to the arithmetic circuit 12 the data of 1 bit which correspond to an intermediate tone so as to read out the data from either of the memory units upon receiving instructions from the controller 2. In this example, the memory units 10*a*, 10*b* are provided to select either of the memory units for pixels whereby a gray shade control can be obtained. In this case, various kinds of methods can be used depending on the instructions of the controller 2 which may be placed outside.

EXAMPLE 5

The column driver described in the above-mentioned examples includes elements used in a conventional gate array, such as the corrector 32, the data selector 34, the gray shade control circuits 36*a*–36*n* and the arithmetic circuit 37 as shown in FIG. 8 and a functional element which may be realized by a conventional V-RAM such as the display RAM 24 and the memories 35*a*–35*n*. Accordingly, other elements required for the liquid crystal driving circuit are the controller 2, the row electrode pattern generating circuit and the row driver 22 as shown in FIGS. 1, 4 and 6. These elements are relatively small in the liquid crystal driving circuit. Accordingly, the major portion of these elements can be gathered to form a single LSI.

For in stance, a circuit constituting the row driver 22, a circuit constituting the controller 2 and a circuit constituting the row data generating circuit 41, which are conventionally used, are formed into a LSI. Or, a circuit constituting the row driver 22, a circuit constituting the controller 2 and a circuit constituting the row data generating circuit 41 are formed in to a single LSI. When such a LSI is used for driving row electrodes, and the column driver described in the above-mentioned examples are used for driving column electrodes, the scale of the driving circuit can be greatly reduced in comparison with the scale of the conventional circuit. Since a plurality of LSIs including the row drivers 22 are generally used, there are a plurality of controllers 2 and row data generating circuits 41 in a single liquid crystal display device. However, it is sufficient that any of them is effective. Even in this case, there is an advantage that the number of chips in the driving circuit is reduced in comparison with a case that the controllers 2 and the row data generating circuits 41 are not formed in a LSI including the row drivers 22.

As described above, in accordance with the present invention, the column electrode driving semiconductor integrated circuit comprises a memory unit including a control circuit for storing display data and outputting the data on each row electrode in simultaneously selected lines, and an arithmetic circuit unit including an arithmetic processing circuit for receiving the data outputted from the memory unit and selection data and for performing arithmetic processing to obtain information of voltages selected by a select and output circuit unit. Accordingly, a memory such as a V-RAM or the like which is provided as a separate element in a conventional liquid crystal driving circuit can be eliminated. By using the integrated circuit of the present invention, the driving circuit can be small-sized as a whole. Further, power consumption in the driving circuit can be reduced. As a result, the application of the driving circuit to a small terminal device can be easy.

In an embodiment of the present invention, the column electrode driving semiconductor integrated circuit comprises a memory unit which outputs data on two lines through 15 lines simultaneously selected, and an arithmetic circuit unit for performing arithmetic processing on selection data of 2 bits through 15 bits and the data outputted from the memory unit. Accordingly, the integrated circuit is suitable for a multiple line selection method wherein 2 lines through 15 lines which are possibly taken, are simultaneously selected. In particular, when the number of simultaneously selected lines is 2 or 3, the integrated circuit is operable with a power source of 5V. In this case, the memory units can be formed in the same manner as the formation of generally used D-RAMs.

The column electrode driving semiconductor integrated circuit in another embodiment of the present invention, a γ-correction is effected to inputted data. Further, the circuit includes a correction unit for a gray shade display treatment. With use of the integrated circuit, the driving circuit can be small-sized as a whole.

In another embodiment of the present invention, the column electrode driving semiconductor integrated circuit has a memory unit which has a capacity of memorizing a plurality of bits for a dot and outputs data of a bit or bits in response to a selection signal. Accordingly, a liquid crystal driving circuit including the integrated circuit can realize a gray shade control without increasing the number of circuits.

In an embodiment of the column electrode driving semiconductor integrated circuit of the present invention, the control circuit of the memory unit outputs data on a plurality of columns at a time, and the arithmetic circuit unit has an arithmetic processing circuit for processing data on a plurality of columns which are read out from the memory unit at a time. Accordingly, arithmetic calculations on a plurality of columns can be simultaneously conducted. Namely, the integrated circuit without increasing a consumption rate of current can be provided since it is unnecessary to increase the frequency of driving clocks.

In an embodiment of the present invention, the row electrode driving semiconductor integrated circuit includes a row electrode selection pattern generating circuit. Accordingly, the size of the liquid crystal driving circuit can be further reduced.

In an embodiment of the present invention, the driving device in a liquid crystal display device has a plurality of arithmetic circuit units in a portion for driving column electrodes. Accordingly, the operational speed required for each of the arithmetic circuit units can be low, whereby the frequency of driving clocks in the row electrode driving portion can be reduced.

In accordance with the present invention, the size of the driving device in a liquid crystal display device driven by a multiple line selection method can be reduced. In some cases, the driving device is operable with a battery. A liquid crystal display device using the driving device of the present invention is suitable for a PDA (personal data assistant) display or a pager display.

Obviously, numerous modifications and variations of the present invention are possible in light of the above teachings. It is therefore to be understood that within the scope of the appended claims, the invention may be practiced otherwise than as specifically described herein.

What is claimed is:

1. A semiconductor integrated circuit for driving column electrodes in a liquid crystal display device to be driven by a multiple line selection method, said semiconductor integrated circuit being used for a liquid crystal display device having a select and output circuit unit which selects a specified voltage value among voltage values having a number of levels corresponding to a number of simultaneously selected row electrodes, and which applies the selected voltage value to each column electrode, the semiconductor integrated circuit comprising:

a memory unit including a control circuit for storing display data and outputting data on each row electrode in simultaneously selected lines, wherein the memory unit comprises at least one of metal oxide semiconductor field effect transistors and complementary metal oxide semiconductors and has a memory column capacity in a memory column direction wherein a number of memories for columns is equal to a number of outputs for columns when memory cells of 1 bit per 1 pixel are used, or a memory column capacity of two times when a gray shade display is effected;

memory signals of at least one of a data signal, a write or read signal, and an address signal as signals to be accessed to the memory cells; and an arithmetic circuit unit including an arithmetic processing circuit provided for an output of each column electrode, said arithmetic processing circuit producing, by arithmetic processing, information of voltages selected by the select and output circuit unit by receiving data output from the memory unit and selection data indicating a voltage pattern applied to the selected row electrodes;

wherein a memory cell of 1 bit has a first node electrode for a first MOS FET which is connected to a data line D and has a second node electrode for an input to a first CMOS inverter and an output to a second CMOS inverter, a second MOS FET has a first node electrode connected to a data line $\overline{D}$ and a second node electrode connected to an output side of the first CMOS inverter and functioning as an input terminal for the second CMOS inverter, and a gate electrode for switch-controlling of the first and second MOS FETs are connected to a word line.

2. The semiconductor integrated circuit according to claim 1, wherein the control circuit of the memory unit outputs data on two lines through fifteen lines simultaneously selected, and the arithmetic processing circuit of the arithmetic circuit unit performs arithmetic processing on selection data of two bits through fifteen bits and the data output from the memory unit.

3. The semiconductor integrated circuit according to claim 2, wherein a memory cell of 1 bit has a first node electrode for a first MOS FET which is connected to a data line D and has a second node electrode for an input to a first CMOS inverter and an output to a second CMOS inverter, a second MOS FET has a first node electrode connected to the data line $\overline{D}$ and a second node electrode connected to an output side of the first CMOS inverter and functioning as an input terminal for the second CMOS inverter, and a gate electrode for switch-controlling of the first and second MOS FETs are connected to a word line.

4. The semiconductor integrated circuit according to claim 1, further comprising a correction unit which conducts at least one of a γ-correction and a gray shade treatment on the display data, and writes treated input data in the memory unit.

5. The semiconductor integrated circuit according to claim 4, wherein a memory cell of 1 bit has a first node electrode for a first MOS FET which is connected to a data line D and has a second node electrode for an input to a first CMOS inverter and an output to a second CMOS inverter, a second MOS FET has a first node electrode connected to the data line $\overline{D}$ and a second node electrode connected to an output side of the first CMOS inverter and functioning as an input terminal for the second CMOS inverter, and a gate electrode for switch-controlling of the first and second MOS FETs are connected to a word line.

6. The semiconductor integrated circuit according to claim 1, wherein the memory unit has a capacity of memorizing a plurality of bits per dot, and outputs at least one bit in response to a selection signal.

7. The semiconductor integrated circuit according to claim 6, wherein a memory cell of 1 bit has a first node electrode for a first MOS FET which is connected to a data line D and has a second node electrode for an input to a first CMOS inverter and an output to a second CMOS inverter, a second MOS FET has a first node electrode connected to the data line $\overline{D}$ and a second node electrode connected to an output side of the first CMOS inverter and functioning as an input terminal for the second CMOS inverter, and a gate electrode for switch-controlling of the first and second MOS FETs are connected to a word line.

8. The semiconductor integrated circuit according to claim 1, wherein the control circuit of the memory unit outputs data on a plurality of columns at a time, and the arithmetic circuit unit has the arithmetic processing circuit for processing data on a plurality of column electrodes which are read out from the memory unit at a time.

9. The semiconductor integrated circuit according to claim 8, wherein a memory cell of 1 bit has a first node electrode for a first MOS FET which is connected to a data line D and has a second node electrode for an input to a first CMOS inverter and an output to a second CMOS inverter, a second MOS FET has a first node electrode connected to the data line $\overline{D}$ and a second node electrode connected to an output side of the first CMOS inverter and functioning as an input terminal for the second CMOS inverter, and a gate electrode for switch-controlling of the first and second MOS FETs are connected to a word line.

10. The semiconductor integrated circuit according to claim 1, further comprising a semiconductor integrated circuit for driving row electrodes in a liquid crystal display device to be driven by a multiple line selection method, and is used for a liquid crystal display device having row drivers for applying voltage levels corresponding to selection data to simultaneously selected row electrodes, wherein the semiconductor integrated circuit for driving row electrodes includes a row electrode pattern generating circuit.

11. The semiconductor integrated circuit according to claim 10, wherein a memory cell of 1 bit has a first node electrode for a first MOS FET which is connected to a data line D and has a second node electrode for an input to a first CMOS inverter and an output to a second CMOS inverter, a second MOS FET has a first node electrode connected to the data line $\overline{D}$ and a second node electrode connected to an output side of the first CMOS inverter and functioning as an input terminal for the second CMOS inverter, and a gate electrode for switch-controlling of the first and second MOS FETs are connected to a word line.

12. The semiconductor integrated circuit according to claim 1, wherein in a simultaneous partial line selection method, a signal line inclusively used for an output signal is provided for the data line D, the data line $\overline{D}$ or a memory, and time sharing driving is effected by using a pre-signal to display data to be simultaneously selected and displayed on two to fifteen lines in the simultaneous partial selection method whereby the number of wirings connected from each memory cell to the arithmetic circuit unit for each column is reduced.

13. The semiconductor integrated circuit according to claim 12, wherein a memory cell of 1 bit has a first node electrode for a first MOS FET which is connected to a data line D and has a second node electrode for an input to a first CMOS inverter and an output to a second CMOS inverter, a second MOS FET has a first node electrode connected to the data line $\overline{D}$ and a second node electrode connected to an output side of the first CMOS inverter and functioning as an input terminal for the second CMOS inverter, and a gate electrode for switch-controlling of the first and second MOS FETs are connected to a word line.

* * * * *